United States Patent [19]

Owens

[11] 4,174,047

[45] Nov. 13, 1979

[54] VENDING MACHINE FOR NEWSPAPERS AND THE LIKE

[75] Inventor: Walter K. Owens, Crestview, Fla.

[73] Assignee: 3-in-1, Inc., Crestview, Fla.

[21] Appl. No.: 883,820

[22] Filed: Mar. 6, 1978

[51] Int. Cl.[2] ..... G07F 11/16

[52] U.S. Cl. ..... 221/154; 221/220; 221/227; 221/241

[58] Field of Search ..... 221/154, 155, 210, 220, 221/224, 226–229, 241, 246, 110, 213, 243

[56] References Cited

U.S. PATENT DOCUMENTS

| | | | |
|---|---|---|---|
| 2,501,434 | 3/1950 | Cameron | 221/155 |
| 3,114,475 | 12/1963 | Etes | 221/227 X |
| 3,318,478 | 5/1967 | Hart | 221/227 |
| 3,685,691 | 8/1972 | Charest et al. | 221/227 X |
| 4,008,828 | 2/1977 | Branchaud | 221/241 |

FOREIGN PATENT DOCUMENTS

| | | | |
|---|---|---|---|
| 422463 | 11/1910 | France | 221/227 |

*Primary Examiner*—Robert J. Spar
*Assistant Examiner*—Edward M. Wacyra
*Attorney, Agent, or Firm*—B. P. Fishburne, Jr.

[57] ABSTRACT

A mechanism kit is provided to enable fast and economical conversion of existing semi-honor newspaper vending machines to machines for dispensing one newspaper or magazine at a time following the insertion of proper coins into the conventional coin control mechanism. The customer thus has access to only a single newspaper and not the full contents of the vending machine after insertion of the coins. A manually operated reciprocating single newspaper gripping, transporting and release device withdraws each paper through a narrow slot in the front, side or top of the dispensing machine cabinet and this device is connected with a reciprocating element of the coin mechanism which is released for movement only after the insertion of proper coins by a customer. An associated cabinet door lock and release linkage releases the door for access by the customer to the last newspaper held on the cabinet door after the customary stack of newspapers is exhausted. Only very minor modification of the most common types of vending machines is required for installation of the mechanism kit.

10 Claims, 7 Drawing Figures

22
52
56
60
62
53
38
36
31
20
21
29
67
69
25
41
37
46
24
23
39
79
78
83
32

VENDING MACHINE FOR NEWSPAPERS AND THE LIKE

BACKGROUND OF THE INVENTION

Machines for vending newspapers or magazines one at a time to customers following the insertion of proper coins are broadly known in the prior art. To comply with the duty to disclose the known prior art under 37 C.F.R. 1.56, the following relevant U.S. Pat. Nos. are made of record in this application: 2,854,168; 2,926,814; 3,168,212; 3,263,859; 3,917,114; 3,934,754.

The chief drawback of known prior art devices for vending newspapers and magazines one at a time is the necessity for designing and manufacturing a commercial machine which is substantially totally new. The prior art proposals have been such that their mechanisms are not well suited for manufacturing as an attachment or kit for ready economical installation in existing vending machines in the field, of which there are thousands, and in newly manufactured machines of the most common types in wide usage.

It is the objective of this invention to fulfill the need for a simple and economical conversion kit of mechanism which can be easily installed in most existing common types of vending machines with only very minor modification of such machines and with no requirement for constructing or designing a completely new machine. The mechanism embodied in the kit is capable of installation in different positions on different types or models of vending machine cabinets to enable the dispensing of single newspapers from a stack one at a time through a slot in the front, side or top of the machine as the particular case may be.

In terms of its most basic elements, the invention embodies a simple reciprocating slide and guide track means which is installed on one wall of the dispensing cabinet internally. Part of the slide structure consists of a spring-urged manually activated and cam released single newspaper gripping, transporting and release device which broadly resembles a human hand. The slide structure is also spring-urged to a retracted position within the machine cabinet while an operating hand lever therefore extends exteriorly of the cabinet at all times. The slide structure is positively connected with a normally locked reciprocatory control element of the coin mechanism which is released to enable movement of the slide structure only after the insertion of proper coins in the coin mechanism by customers.

The invention additionally includes simplified means to automatically release the door of the dispenser to provide access to the final newspaper or magazine usually held on the door after the main stack of newspapers has been exhausted. A means is also included in the invention to facilitate reloading the cabinet by a distributor or courier at proper times, and this latter means operates in conjunction with a spring-urged elevator or stack shifting shelf within the dispensing cabinet. A simple anti-theft device is also included to prevent customers from reaching through the dispensing slot and removing papers by hand and a key-operated adjusting means for the newspaper gripping and transporting device is provided so that the device can accommodate papers or magazines of different thicknesses.

Other features and advantages of the invention over the prior art will become apparent during the course of the following description.

DETAILED DESCRIPTION

Figures 1, 3:
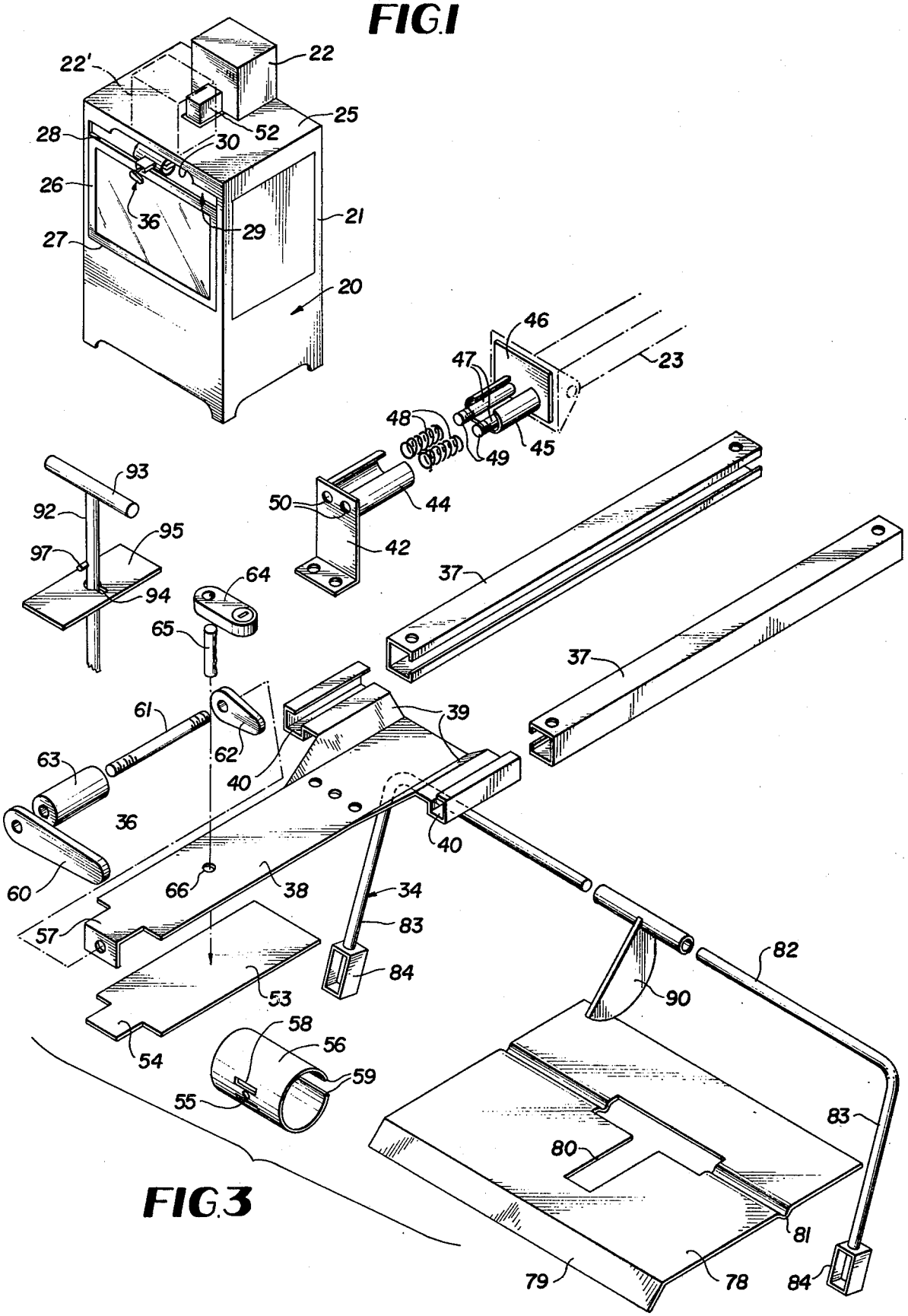
FIG. 1 is a perspective view of a newspaper or magazine vending machine equipped with the invention.
FIG. 3 is an exploded perspective view showing the details of elements of the assembled mechanism in FIG. 2, parts omitted.

Referring to the drawings in detail, wherein like numerals designate like parts, the numeral 20 designates a conventional widely manufactured type of so-called semi-honor coin controlled newspaper vending machine to which the conversion kit forming the subject matter of the invention is readily applicable with only a minimum amount of modification. The vending machine 20 comprises an upstanding rectangular cabinet 21 having a completely conventional coin control mechanism 22 mounted on its top wall adjacent to its rear side. The use of the conversion kit requires moving the standard coin mechanism 22 to the rear of the cabinet 21 from its usual forward position shown in broken lines in FIG. 1 at 22'. The standard coin mechanism 22 has a lower horizontally reciprocatory control element or bar 23 which is normally locked in a rearward retracted position until released for forward horizontal movement following the depositing of proper coins into a chute 24 of the coin mechanism 22 as graphically illustrated in FIG. 4. The details of the coin control mechanism 22 are conventional and except for the correlation of the member 23 with the invention mechanism, as will be further described, forms no part of the invention. The control member 23 is located slightly above the top wall 25 of the vending cabinet 21, FIG. 4.

Figure 7:
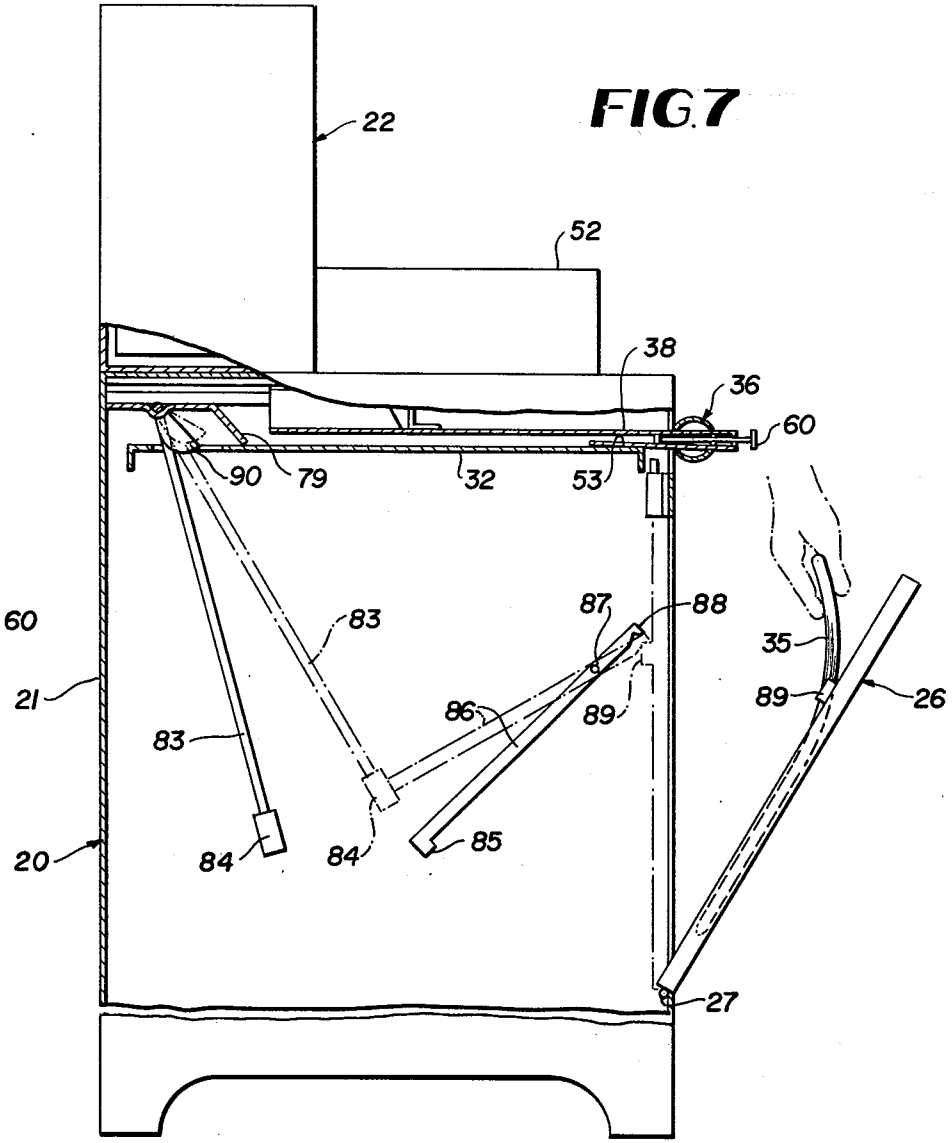

The existing dispensing machine 20 normally includes a front vertically swingable access door 26 at the upper portion of the cabinet which is hinged to swing forwardly and downwardly, FIG. 7, on a transverse horizontal hinge axis 27. To accommodate the kit forming the invention, the top edge 28 of the access door 26 is cut downwardly somewhat and suitably reinforced to produce a horizontal transverse comparatively narrow single newspaper or magazine dispensing slot 29 in the front of the cabinet 21 near and below the top wall 25, said slot having a vertically enlarged center portion 30 to provide clearance for elements of the kit mechanism, to be described. No other modifications of the conventional dispensing machine 20 of any significance are required for the installation of the conversion kit except for a few very minor drilling and metal cutting procedures which can easily be performed in the field and need not be described herein in detail for a proper understanding of the invention.

It can be noted at this point that the invention is being illustrated and described in association with the most widely used semi-honor newspaper or magazine vending machine of which there are thousands in the field. The conversion kit forming the invention can be embodied in this machine at the time of manufacturing and can be readily installed in the field to convert the machine quickly and economically to a dispenser for newspapers or magazines, one at a time, by means of the invention while the access door 26 remains locked. This eliminates the customary semi-honor arrangement where the customer, after depositing proper coins, opens the access door and could if he wished remove more than one paper or magazine.

It can also be stated that the invention is applicable to other types of commercial dispensing machines where newspapers are removed edge-wise through the top of the machine or through the front or one side thereof on edge vertically. The papers in the machine 20 are disposed in a horizontal stack 31, FIG. 4, and are removed forwardly one at a time by means of the invention through the horizontal slot 29. The kit forming the invention is very versatile and can be installed on all of the most common types of machines in the field with only minor alterations of the machine at substantially any operating angle which is necessitated.

The conversion kit proper embodying the invention comprises, within the existing cabinet 21, a horizontal support shelf 32 for the stack of newspapers 31, the shelf being constantly urged upwardly by spring-loaded telescopic suspension arms 33 at opposite sides of the shelf, to be fully described. The front access door 26 is normally locked closed by a lock and release mechanism 34 until the last newspaper in the stack 31 has been dispensed through the slot 29, following which the mechanism 34 will automatically release the door 26 so that the last newspaper 35, FIG. 7, customarily mounted on the interior of the door 26 may be dispensed to a customer. The mechanism 34 will be fully described.

The remaining and most important component of the invention is a customer-operated single newspaper gripping, transporting and release mechanism 36 located immediately under the cabinet top wall 25 and reciprocating horizontally in the cabinet and through the dispensing slot 29.

Figure 2:
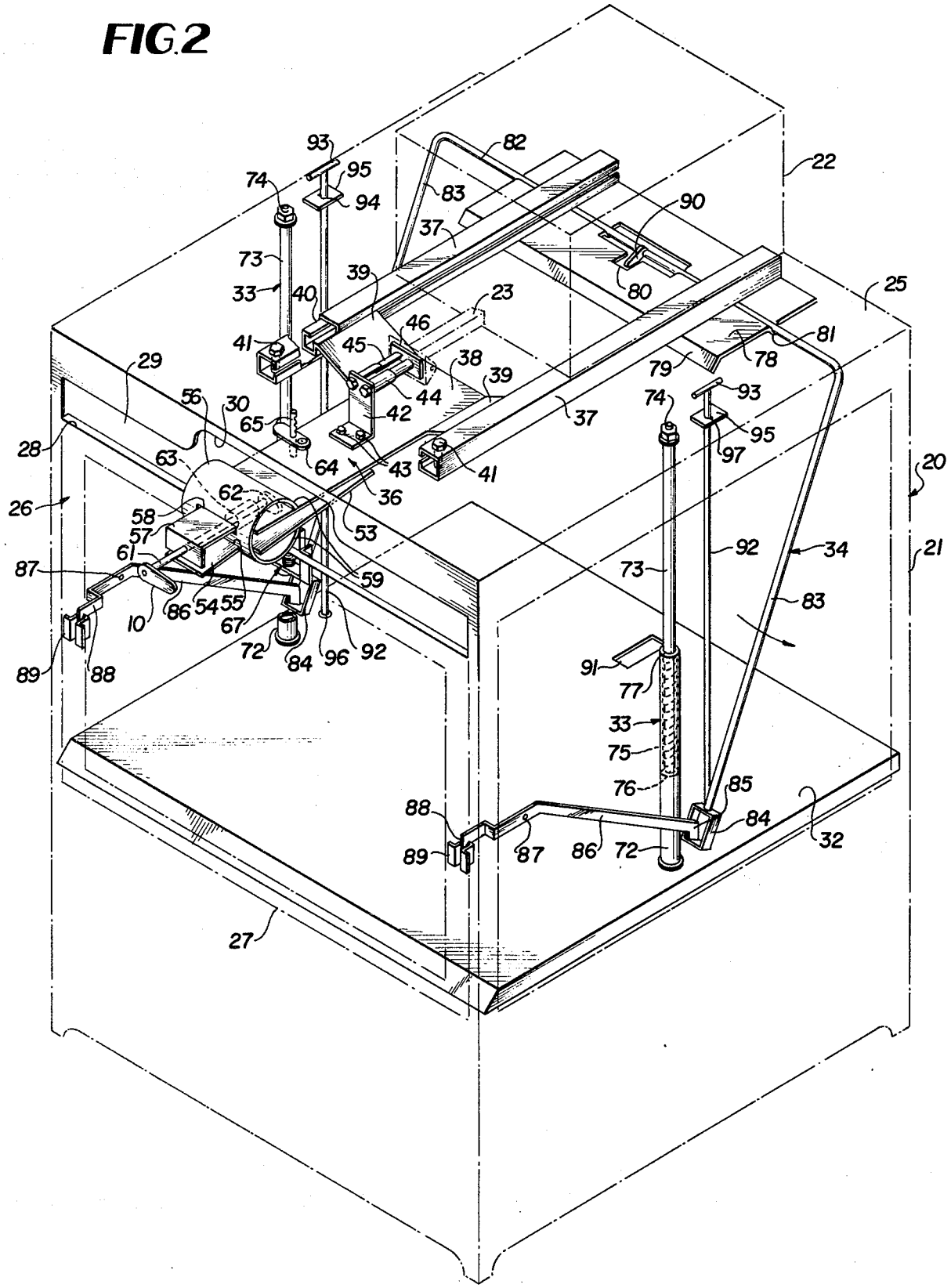
FIG. 2 is an enlarged perspective view of the mechanism kit embodying the invention with the existing dispensing cabinet in which the mechanism kit is installed shown in phantom lines.

The mechanism 36 comprises a pair of front-to-back parallel horizontal channel cross section guide tracks 37 which are installed by bolting to the bottom side of the top wall 25 in the positions best shown in FIG. 2. The horizontal forwardly and rearwardly shiftable slide plate 38 includes rear end lateral extensions 39 having integral parallel longitudinal channel slides 40 which slidably engage within the channel tracks 37 and are smoothly guided by the tracks during forward and rear horizontal movement. The forward mounting bolts 41 for the guide tracks 37 prevent separation of the slides 40 from the tracks when the mechanism 36 is pulled forwardly by a customer. Along with the tracks 37, the slide plate 38 is located below the cabinet top wall 25 and can project forwardly through the slot 29.

An upstanding L-bracket 42 is fixedly attached to the top of slide plate 38 as by bolts 43 and the bracket 42 can be mounted in different lateral positions on the plate 38 to accommodate different dispensing machines. The top of bracket 42 carries a rearwardly extending horizontal channel 44 receiving telescopically a mating channel 45 attached to a head element 46 which is rigidly secured to the horizontally shiftable normally locked and coin released control member 23 of the conventional coin mechanism. The head element 46 carries forwardly projecting parallel rods 47 which engage through the bores of compression springs 48 when the two channels 45 and 44 are telescopically engaged. Threaded ends 49 of the rods 47 engage through openings 50 at the top of bracket 42 and are secured by nuts 51, FIG. 2.

Figures 4, 5:
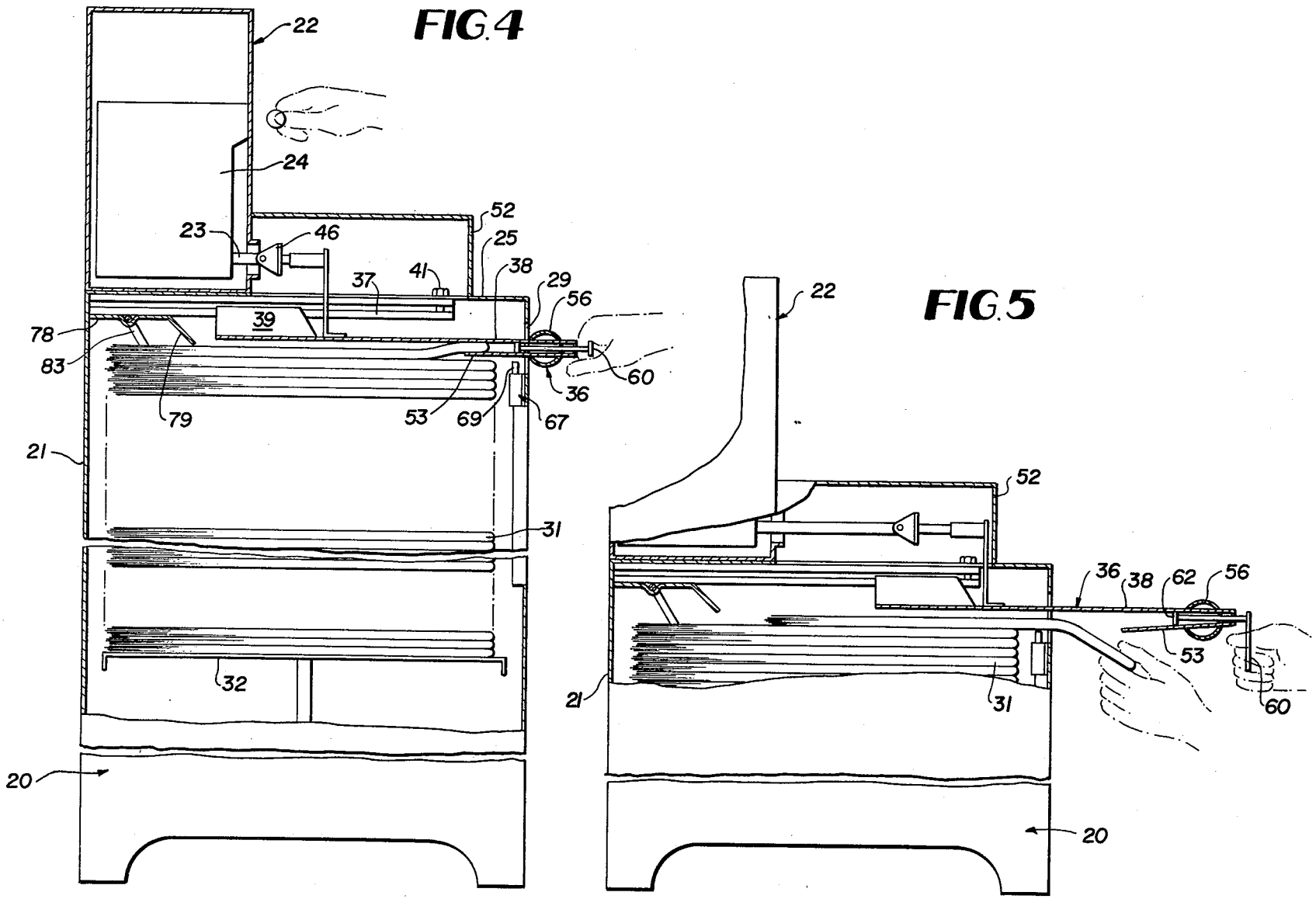
FIGS. 4, 5, 6 and 7 are partly schematic elevational views depicting the operation of the invention.

The purpose of the telescoping spring-loaded connection between the bracket 42 and head element 46 is to provide in the mechanism 36 the proper amount of play to enable a customer to properly engage and grip the top newspaper in the stack 31 while pushing inwardly or rearwardly on the apparatus 36, as will be further described. When the mechanism 36 is at rest, FIGS. 2 and 7, the springs 48 take up the slack or play between bracket 42 and head element 46. The elements 23, 46, 45 and 44 are disposed above the cabinet top wall 25, and hence a suitable opening, not shown, is formed in the top wall 25 to allow passage of the upright bracket 42 therethrough. A suitable housing 52 for the operating elements which are above the top wall 25 is provided, as best shown in FIGS. 1 and 4.

The mechanism 36 further comprises a newspaper gripping jaw or plate 53 below the forward portion of slide plate 38 and having a forward tongue 54 engaging through a lower slot 55 of a strong C-spring 56 which serves to power the jaw 53 to a closed or gripping position against the bottom of slide plate 38 with which the jaw 53 moves horizontally. The slide plate 38 has a forward tongue 57 which similarly engages through an upper slot 58 of C-spring 56 in overlying relationship to the jaw tongue 54, FIG. 2. Rearwardly of the tongues 54 and 57, both the jaw 53 and slide plate 38 have their forward portions extending between the curved clamping jaws 59 of spring 56.

A customer-operated handle 60 is disposed forwardly of the cabinet door 26 and slot 29 and secured firmly to a rotary horizontal shaft 61 having a cam 62 securely attached to its rear end and lying between the jaw 53 and slide plate 38. A spacer 63 is mounted on the rotary shaft 61 between the cam 62 and spring 56 to prevent axial movement of the cam when the handle 60 is pulled forwardly.

To compensate for daily changes in thickness of newspapers, an adjustable key-operated lock 64 to be operated by the newspaper supplier fits adjustably over a toothed post 65 rigid with the jaw 53 and rising therefrom. The post 65 extends through an aperture 66, FIG. 3, in the slide plate 38. The lock rides on top of the slide plate 38 and can be adjusted by anyone having the proper key upwardly or downwardly on the post 65 to vary the gripping gap between the jaw and slide plate.

Beneath the mechanism 36 at the enlarged slot portion 30 is an anti-theft assembly 67 attached by flanges 68 to the interior of the access door 26. This unit is designed to prevent insertion of the human hand through the dispensing slot at the top of a door and removing a newspaper from the stack 31. The unit comprises a blocking plate 69 slidably mounted in a casing 70 and urged upwardly by springs 71 toward contact with the bottom of a newspaper as it is withdrawn from the slot 29 by the gripping and transporting mechanism 36. The arrangement is such that, regardless of the thickness of the paper or magazine, the blocking plate 69 will always block placement of the hand through the slot portion 30 underneath the mechanism 36.

As previously noted, the suspension arms 33 for the shelf 32 consist of guide tubes 72 whose lower ends are attached by welding or the like to the shelf 32 near the opposite sides and fore and aft center of the shelf. Coacting rods 73 have their upper ends anchored at 74 to the cabinet top wall 25 and extend telescopically into the guide tubes 72. Expansion springs 75 surround the rods 73 in the guides 72 and have their lower ends bearing on heads 76 of the rods 73 at their lower ends, the upper ends of the springs engaging annular top walls 77 of the guide tubes so as to constantly urge the guide tubes and the newspaper stack supporting shelf or tray 32 upwardly in the dispensing machine.

Acting in opposition to the spring-urged shelf 32 is a newspaper stack hold-down and stabilizing plate 78 having a downturned forward lip 79 always bearing on the topmost newspaper in the stack 31. The plate 78 has a T-shaped opening 80 formed therethrough and has a transverse top opening channel 81 formed across the plate 78 and forming a seat and journal for a transverse rocker shaft 82 forming part of the beforementioned access door lock and release mechanism 34. The hold-down and stabilizing plate 78 is suitably attached to the bottoms of the guide tracks 37, as shown in FIG. 2, and is disposed near the rear of these tracks.

As the shelf 32 gradually rises due to removal by customers of newspapers one at a time from the top of the stack 31, the plate 78 always engages and stabilizes the next upcoming newspaper so that it will be properly positioned to be engaged and gripped between the jaw 53 and slide plate 38 as the customer utilizes the mechanism 36 which can be said to broadly resemble the action of a human hand reaching in and grasping a top newspaper and then withdrawing it forwardly through the slot 29 and releasing it. This action will be further described.

The access door lock and release mechanism 34 additionally comprises side depending arms 83 on opposite ends of the rocker shaft 82. The lower ends of arms 83 carry locking loops 84 which normally receive and lock rear hook extensions 85 of counterweighted access door lock and release arms 86. The arms 86 are pivoted at 87 to the cabinet side walls with their longer and heavier end portions projecting rearwardly of the pivots 87 and being normally supported by the locking loops 84. The forward ends of arms 86 have door locking extensions 88 which lockingly engage keeper brackets 89 secured to the interior side of access door 26 near the cabinet side walls. Thus, as long as the rearward heavier ends of the arms 86 are held upwardly by the loops 84, the door 26 is locked and cannot be pulled open. When the last newspaper in the stack 31 has been dispensed in the normal manner, a weighted cam 90 on the rocker shaft 82 which normally rides on the uppermost newspaper to hold the mechanism 34 in the door locking position responds by gravity to the absence of the last newspaper in the stack and drops through the slot 80 in stabilizing plate 78 and may also pass through a registering slot 91 in the shelf 32 which is now in a top elevated position due to the action of springs 75. This dropping of the element 90 rotates the rocker shaft 82 and swings the arms 83 rearwardly so that their bottom loops 84 disengage the counterweighted arms 86 allowing their heavier rearward portions to drop, raising the door locking elements 88 from the keeper brackets 89 and allowing the access door 26 to be opened by a customer to receive the last newspaper 35, FIG. 7, mounted on the door 26. The door 26 cannot be opened until the last newspaper in the stack 31 is dispensed.

Another feature of the invention conversion kit is the provision of a pair of loading bars 92 equipped with top handles 93 to be used by the newspaper agent or supplier in the loading of the dispenser cabinet. The bars 92 are insertable through key lock openings 94 in upper guide plates 95, FIGS. 2 and 3, secured to the top wall 25. The lower ends of the bars 92 are engageable within small sockets 96 in the shelf 32 by the attendant so that the shelf can be fully lowered in the cabinet to the stack loading position, FIG. 2, by simply pushing downwardly on the bars 92 which compresses the springs 75. The loading bars 92 are equipped near their tops with small side projecting lugs 97 which, in one position of rotation, can pass through the keyhole openings 94 and following rotation of the bars 92 will become locked below the plates 95 to hold the shelf 32 down in the loading position. Once the newspapers are loaded onto the shelf 32, the agent can simply rotate and elevate the loading bars 92 and separate them from the dispensing or vending machine. The bars 92 are not to be used by customers and have nothing to do with the newspaper dispensing sequence.

SUMMARY OF DISPENSING OPERATION

The dispensing operation can best be understood by referring to operational FIGS. 4 to 7 inclusive. In FIG. 4, a customer is inserting proper coins into the coin mechanism chute 24 in order to release the bottom horizontal control element 23 which is locked against forward movement until released. This much of the operation is conventional due to the internal workings of the standard coin control mechanism 22.

Following release of the control element 23, the customer can grasp the handle 60 which is now in the retracted position toward the rear of the cabinet 21 with the entire mechanism 36. Prior to such grasping, the handle 60 has been in a vertical position, FIG. 6, to spread the jaw 53 from the slide plate 38 so that these elements may receive between them the folded edge of the topmost newspaper in the stack 33. As shown in FIG. 4, the folded edge of each newspaper is rounded so that there will be smooth entry of the newspaper between the open jaw 53 and plate 38 when the mechanism 36 is thrust inwardly or rearwardly by a customer, FIG. 6.

Again referring to FIG. 4, after insertion of proper coins, the customer rotates the handle 60 to a horizontal position whereby the jaw actuating cam 62 releases the jaw 53 so that it may close tightly on the newspaper and clamp or grip the same against slide plate 38. The customer then pulls the handle 60 forwardly as indicated by the arrow in FIG. 4 until the mechanism 36 reaches the position shown in FIG. 5. In such position, the newspaper has passed through the delivery slot 29 and can be grasped by the customer for full removal. However, prior to such grasping and removal, the customer first rotates the handle 60 to the vertical position to again open the jaw 53 so that the mechanism 36 will be reset to engage and grasp the next newspaper at the top of the stack 31 which is automatically elevated into contact with the stabilizing plate 78 by the spring action on the shelf 32. The dispensed newspaper is then grasped by the customer's other hand and fully removed from the vending machine, FIG. 5.

Figure 6:
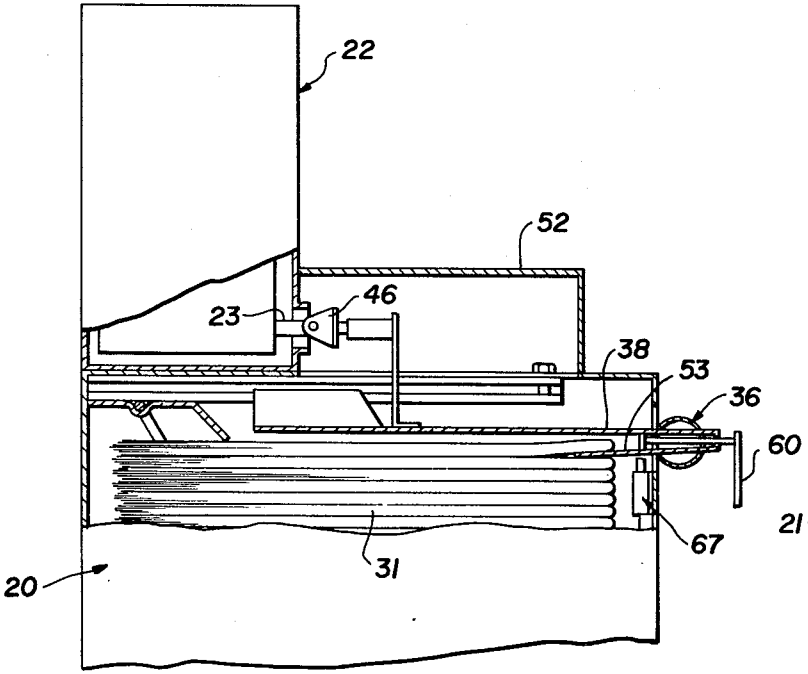

Following removal of the newspaper in FIG. 4, the customer merely releases the handle 60 which is still in the vertical position, and the control element 23 which is spring-urged rearwardly to a normal locking position automatically retracts the mechanism 35 with it to the position shown in FIG. 6 where the next newspaper at the top of the stack becomes engaged between the jaw 53 and slide plate 38. Hence, the next customer following insertion of proper coins simply turns the handle 60 to the horizontal position, FIG. 4, and pulls out the newspaper to the position of FIG. 5, as described. The operation is very simple and very direct. The mechanism 36 is broadly similar to a human hand reaching rearwardly and grasping each folded newspaper in succession, transporting it forwardly through the slot 29 and then releasing it. During this repetitive operation, the ever-present plate 78 coacts with the spring elevated shelf 32 to present and stabilize each newspaper at the proper elevation in alignment with the slot 29 near the top of the cabinet so that the paper can be efficiently engaged by the customer operated mechanism 36.

When the final newspaper in the stack 31 is dispensed in this manner, the cam weight 90 which normally rides on the topmost newspaper has nothing to support it and drops into the slots 80 and 91 which are in registration with the shelf 32 now near the plate 78. As this occurs, the loops 84 swing rearwardly and release the counterweighted arms 86 which drop rearwardly of pivots 87 raising the locking elements 88 from the keepers 89 so that the access door 26, FIG. 7, can be pulled open by the customer who is purchasing the last newspaper 35 customarily held and displayed on the inside of the door 26.

It is now apparent that the invention is characterized by simplicity and ease of operation by the customer. It is rugged and durable and requires no adjusting after proper installation except for the adjustment of the key operated lock 64 by the newspaper supplier to compensate for changes in thickness of the newspaper, as previously described. Sunday and daily newspapers can be accommodated by the invention. The anti-theft assembly 67 and the loading assist bars 92 add greatly to the practicality of the invention.

It is again to be noted that the kit constituting the invention can selectively be installed on a vending machine cabinet as illustrated in the drawings for dispensing through a horizontal slot at the front or side wall of a cabinet, or in some cases, the kit can be installed to dispense papers or magazines vertically through a slot in the top of the cabinet, either front-to-back or transversely of the cabinet. In other cases, the kit can be installed to dispense through a vertical slot in any side wall of the cabinet. The same mechanism will operate equally well in any of these situations and the only difference would be in the minor modifications which would have to be performed on each style of cabinet to accept the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a vending machine for newspapers and the like, a rectangular cabinet adapted to contain a plurality of newspapers in stacked relationship, said cabinet having a single newspaper dispensing slot formed in one wall thereof, a coin mechanism on said cabinet having a normally locked coin released control element spaced from said slot, and a reciprocatory single newspaper gripping, transporting and releasing device mounted on one wall of said cabinet and being connected to said control element of the coin mechanism and being manually movable within and through said slot when said control element is in a released state following the depositing of proper coins in the coin mechanism by a customer, said gripping, transporting and releasing device comprising a reciprocatory slide member, a coacting jaw member, a spring biasing the jaw member toward newspaper gripping relationship with the slide member, a manually operable camming means on said device to shift the jaw member away from the slide member to a newspaper releasing position, a spring-urged panel element in said cabinet engaging a stack of newspapers therein and biasing one endmost newspaper in the stack in one direction, and a coacting opposing newspaper stabilizing member in said cabinet in spaced relationship to said panel element and engaging said endmost newspaper to position and stabilize it for engagement by said device with said slide member and jaw member on opposite sides of said newspaper, whereby said endmost newspaper is gripped by said device, transported by said device through said slot and then delivered directly to the customer.

2. In a vending machine for newspapers and the like as defined in claim 1, and said cabinet having a hinged access door in one wall thereof, and a gravity responsive locking means for said access door normally holding said door in a locked condition and including a weight element riding on an endmost newspaper in said stack and dropping by gravity when the last newspaper in said stack is dispensed by the operation of said newspaper gripping, transporting and releasing device to automatically release said access door for opening by a customer so that a final newspaper on said door is made accessible to said customer.

3. In a vending machine for newspapers and the like as defined in claim 1, and a separable means operable within said cabinet by a newspaper supplier to shift said spring-urged panel element away from said stabilizing member to facilitate loading said cabinet with a stack of newspapers through an access door of the cabinet.

4. In a vending machine for newspapers and the like as defined in claim 1, and a spring-loaded lost motion connection interposed between said control element of the coin mechanism and said gripping, transporting and releasing device, whereby there is sufficient play in said device to allow proper engagement of the device with each newspaper being dispensed from said stack.

5. In a vending machine for newspapers and the like as defined in claim 1, and a lockable adjusting device for said jaw member on said device to allow ready adjusting of the gap between the jaw member and said slide member by a newspaper supplier.

6. In a vending machine for newspapers and the like as defined in claim 1, and a spring-urged anti-theft unit on said one wall of the cabinet adjacent said dispensing slot and located on one side of said gripping, transporting and releasing device and preventing insertion of a hand into said cabinet through said slot.

7. In a vending machine for newspapers and the like as defined in claim 1, and said slide member and coacting jaw member of said device comprising opposing plates, a C-spring grippingly engaging end portions of said plates and urging the jaw member toward the slide member, and said camming means comprising an eccentric cam engaging between said opposing plates, a rotary shaft carrying said cam, and a customer-operated handle secured to the rotary shaft exteriorly of said cabinet and said slot.

8. In a vending machine for newspapers and the like as defined in claim 7, and a pair of spaced parallel guide tracks for said slide member within said cabinet on said one wall of the cabinet which carries said device.

9. In a vending machine for newspapers and the like as defined in claim 8, and a pair of opposite side slides carried by said slide member and being guidably engaged with said guide tracks for linear reciprocation toward and away from said slot.

10. In a newspaper or like article vending machine having a rectangular cabinet provided in one wall thereof with a single newspaper dispensing slot, a customer-operated single newspaper gripping, transporting and releasing device movable through said slot, said device being operable by the customer exterior to the cabinet said device having a connection with a control element of a coin mechanism on said cabinet which is released for reciprocation following the placement of proper coins by a customer in the coin mechanism, said device adapted to reciprocate in a linear path with said coin mechanism control element, and spring-urged means within said cabinet bearing on a stack of newspapers therein and presenting the newspapers in the stack one at a time at a stabilized position aligned with said slot for ready engagement by said device, whereby the endmost newspaper in said stack of newspapers is gripped by said device, transported by said device through said slot and then delivered directly to the customer.

* * * * *